US011506028B2

(12) United States Patent
Provost

(10) Patent No.: US 11,506,028 B2
(45) Date of Patent: Nov. 22, 2022

(54) RECIRCULATING GRAVEL PACK SYSTEM

(71) Applicant: Wilfred Provost, Tomball, TX (US)

(72) Inventor: Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 46 days.

(21) Appl. No.: 16/999,194

(22) Filed: Aug. 21, 2020

(65) Prior Publication Data

US 2022/0056787 A1 Feb. 24, 2022

(51) Int. Cl.
*E21B 43/04* (2006.01)
*E21B 43/08* (2006.01)
*E21B 34/06* (2006.01)

(52) U.S. Cl.
CPC ..... *E21B 43/045* (2013.01); *E21B 34/06* (2013.01); *E21B 43/086* (2013.01); *E21B 2200/05* (2020.05); *E21B 2200/06* (2020.05)

(58) Field of Classification Search
CPC ..... E21B 43/045; E21B 34/06; E21B 43/086; E21B 2200/06; E21B 2200/05
See application file for complete search history.

(56) References Cited

U.S. PATENT DOCUMENTS

| | | | | |
|---|---|---|---|---|
| 4,932,474 | A | 6/1990 | Schroeder, Jr. et al. | |
| 2002/0096328 | A1 | 7/2002 | Echols et al. | |
| 2003/0000702 | A1 | 1/2003 | Streich et al. | |
| 2007/0246213 | A1 | 10/2007 | Hailey, Jr. | |
| 2009/0025923 | A1* | 1/2009 | Patel | E21B 43/045 166/51 |
| 2011/0240290 | A1* | 10/2011 | Jasek | E21B 43/04 166/278 |
| 2012/0227839 | A1* | 9/2012 | Veit | E21B 43/25 137/538 |
| 2014/0020898 | A1* | 1/2014 | Holderman | E21B 43/08 166/304 |
| 2015/0308238 | A1* | 10/2015 | Langlais | E21B 43/04 166/278 |
| 2016/0333655 | A1* | 11/2016 | Fripp | E21B 29/02 |
| 2018/0094508 | A1* | 4/2018 | Smith | E21B 43/26 |

OTHER PUBLICATIONS

International Search Report and Written Opinion for International Application No. PCT/US2021/071194; International Filing Date Aug. 16, 2021; dated Nov. 22, 2021 (pp. 1-9).

* cited by examiner

*Primary Examiner* — Christopher J Sebesta
*Assistant Examiner* — Neel Girish Patel
(74) *Attorney, Agent, or Firm* — Cantor Colburn LLP

(57) ABSTRACT

A recirculating gravel pack system includes a tubular member having an outer surface, an inner surface defining a flow path, a first opening extending from the inner surface through the outer surface and a second opening, spaced from the first opening extending from the inner surface through the outer surface. A screen is positioned about the tubular member spaced from the outer surface defining a passage that is selectively fluidically connected to the second opening. A return tube extends between the screen and the outer surface running axially along the tubular member. The return tube includes a first end defining an inlet arranged in the passage and a second end defining an outlet positioned in a low-pressure zone outside the passage downhole from the first opening.

21 Claims, 4 Drawing Sheets

RECIRCULATING GRAVEL PACK SYSTEM

BACKGROUND

In the resource recovery industry, it is often times necessary to install equipment at a sandface or internal surface of a wellbore. The equipment also benefits from sand control, in the form of screens, that allow formation fluid in but exclude sand and other debris that may impede flow. Often times sand control is supported by a gravel pack in which a slurry is deposited in an annulus between two packers.

Typically, the slurry is run into a tubular as a fluid flow passing into the wellbore, the slurry exits the tubular between the two packers depositing the slurry. The fluid flow passes through a screen assembly, is filtered and run back into the tubular and returned to the surface. Special equipment is required to guide the slurry down hole and clean fluid back uphole. For example, a crossover tool may be installed into the wellbore.

The use of a crossover tool or other equipment that directs fluid back up hole requires a certain amount of space in the wellbore. Even more so for multizone single trip systems. As such, the wellbore must be sized to accommodate the additional equipment. Further, at the surface there must provisions for storing and treating the fluid coming back uphole. As such, the industry would welcome a system for gravel packing that did not require the use of crossover tools, circulated fluid storage and the like.

SUMMARY

Disclosed is a recirculating gravel pack system including a tubular member having an outer surface, an inner surface defining a flow path, a first opening extending from the inner surface through the outer surface and a second opening, spaced from the first opening extending from the inner surface through the outer surface. A screen is positioned about the tubular member spaced from the outer surface defining a passage that is selectively fluidically connected to the second opening. A return tube extends between the screen and the outer surface running axially along the tubular member. The return tube includes a first end defining an inlet arranged in the passage and a second end defining an outlet positioned in a low-pressure zone outside the passage downhole from the first opening.

Also disclosed is a resource exploration and recovery system including a surface system, and a subsurface system including a recirculating gravel pack system including a tubular member having an outer surface, an inner surface defining a flow path, a first opening extending from the inner surface through the outer surface and a second opening, spaced from the first opening extending from the inner surface through the outer surface. A screen is positioned about the tubular member spaced from the outer surface defining a passage that is selectively fluidically connected to the second opening. A return tube extends between the screen and the outer surface running axially along the tubular member, the return tube including a first end defining an inlet arranged in the passage and a second end defining an outlet positioned in a low-pressure zone outside the passage downhole from the first opening.

Further disclosed is a method of gravel packing including directing a flow of fluid including a slurry into a tubular member, passing the flow of fluid from the tubular member into a wellbore, accumulating slurry at a sand screen supported by the tubular member, passing a filtered portion of the flow of fluid into a passage arranged radially inwardly of the sand screen, drawing the filtered portion of the flow of fluid into a return tube having an outlet, and discharging the filtered portion of the flow of fluid from the outlet into the flow of fluid passing from the tubular member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
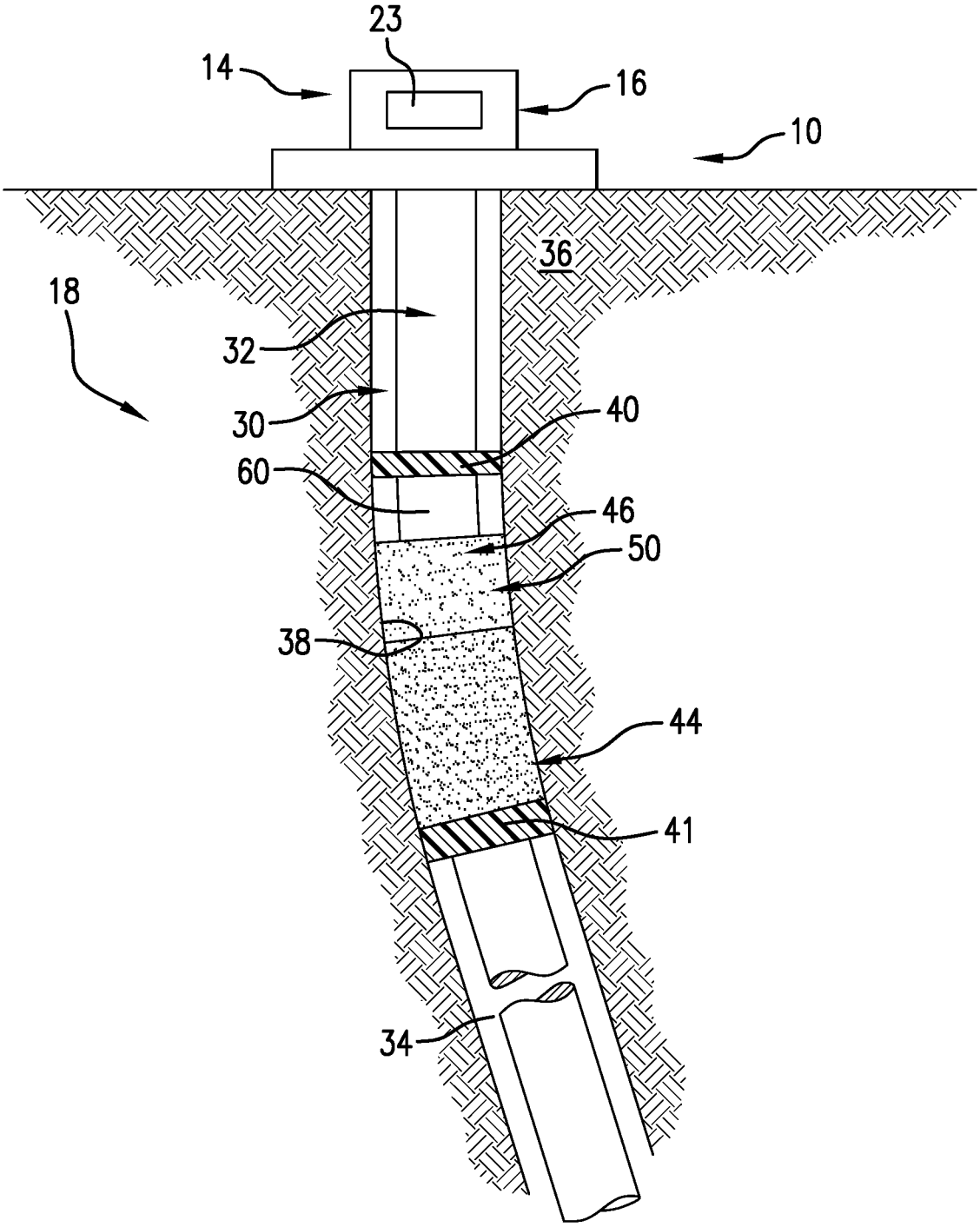
FIG. 1 depicts a resource exploration and recovery system including a recirculating gravel pack system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system. First system 14 may include a control system 23 that may provide power to, monitor, communicate with, and/or activate one or more downhole operations as will be discussed herein. Surface system 16 may include additional systems such as pumps, fluid storage systems, cranes and the like (not shown).

Second system 18 may include a tubular string 30, formed from one or more tubular members, such as indicated at 32, which extends into a wellbore 34 formed in a formation 36. Wellbore 34 includes an annular wall 38 which may be defined by a surface (not separately labeled) of formation 36. Tubular member 32 supports a first packer 40 and a second packer 41. A production zone 44 is defined between first and second packers 40 and 41. The number, length and spacing of production zones may vary. A sand screen system 46 is provided on tubular member 32 in production zone 44. Sand screen system 46 filters production fluids flowing into second system 18. Sand screen system 46 supports a recirculating gravel pack system 50 that deposits a slurry that builds up in an annular space (not separately labeled between annular wall 38 and sand screen system 46. The slurry supports annular wall 38 during fracturing and production operations.

Figure 2:
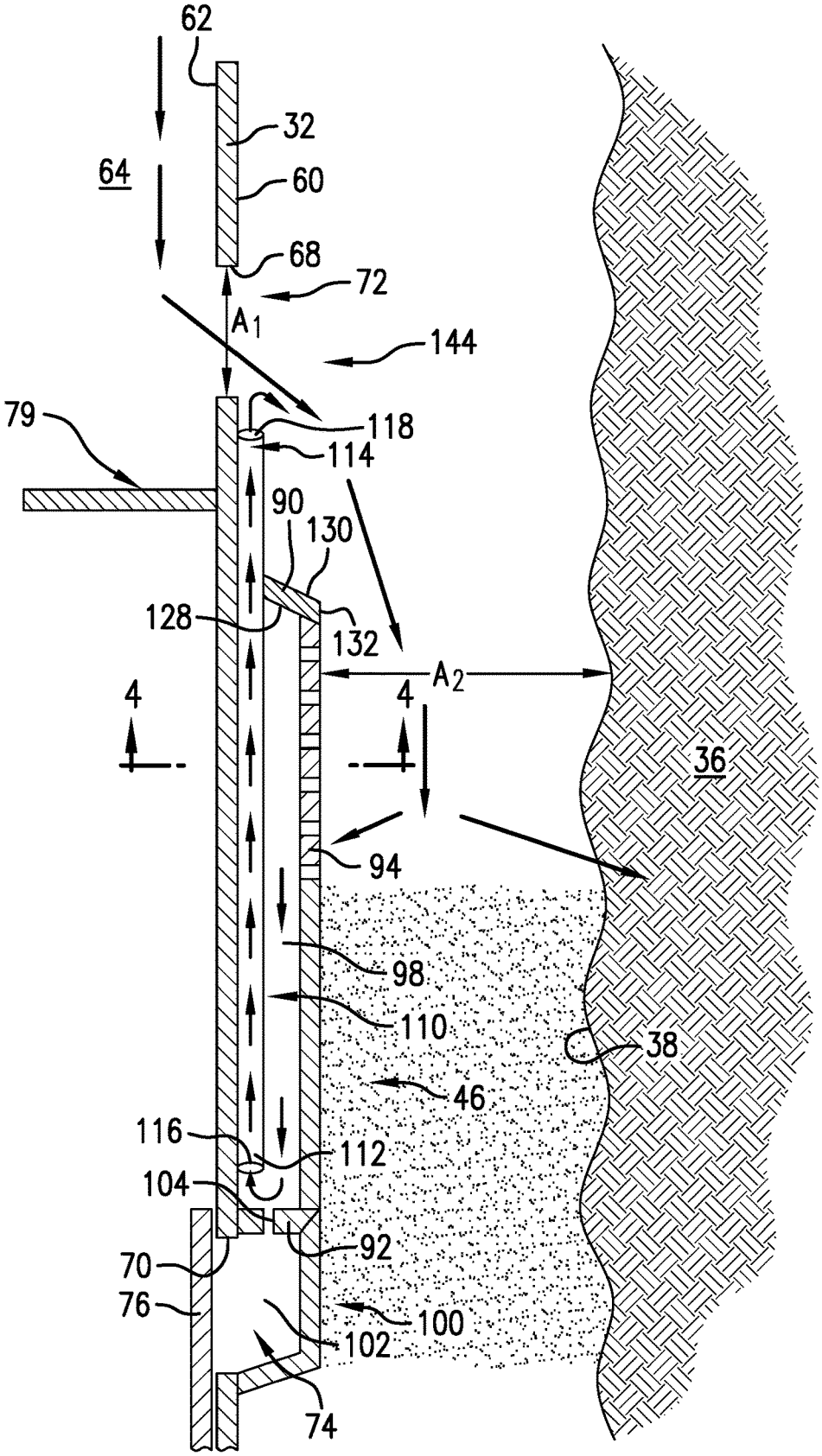
FIG. 2 depicts a partial cross-sectional view of the recirculating gravel pack system of FIG. 1, in accordance with an aspect of an exemplary embodiment.

Referring to FIG. 2, tubular member 32 includes an outer surface 60 and an inner surface 62 that defines a flow path 64 that extends in a downhole direction and in an uphole direction to surface system 16. Tubular member 32 includes a first opening 68 and a second opening 70. First opening 68 defines a frac port 72 and second opening 70 defines a production port 74. At this point, it should be understood that multiple frac ports may extend annularly about tubular member 32. Similarly, a number of production ports may extend annularly about tubular member 32.

Frac port 72 may be selectively covered by a frac sleeve (not shown) and production port 74 may be selectively covered by a production sleeve 76. A valve member 79, which may take on various forms including flapper valves, drop balls and the like, selectively fluidically isolates production port 74 from frac port 72. That is, during a fracturing operation, valve member 79 may be in a closed configuration and, during production, valve member 79 may be opened.

Sand screen system 46 includes a first support member 90 and a second support member 92. A screen element 94 extends between first and second support members 90 and 92. Screen element 94 may include one or more layers of perforated materials that filter production fluids passing into flow path 64. A screen passage 98 extends between outer surface 60 and an inner surface (not separately labeled) of screen element 94. A production collar 100 may be arranged downhole from second support member 92. Production collar 100 may include a production chamber 102 that is fluidically coupled to flow path 64 via production port 74 and to screen passage 98 via a production passage 104 formed in second support member 92.

Figure 3:
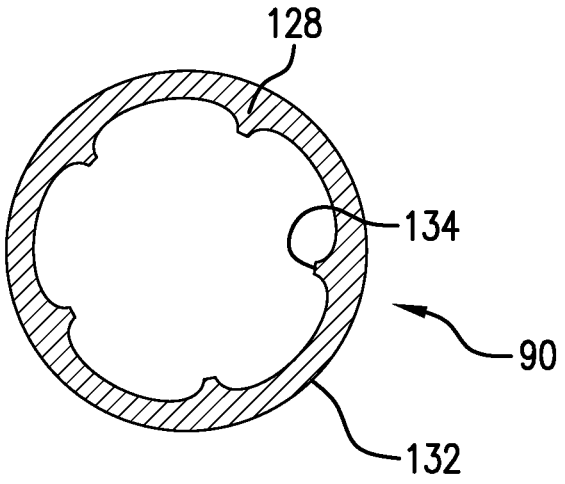
FIG. 3 depicts an axial end view of a support ring of the recirculating gravel pack system, in accordance with an exemplary aspect.
Figure 4:
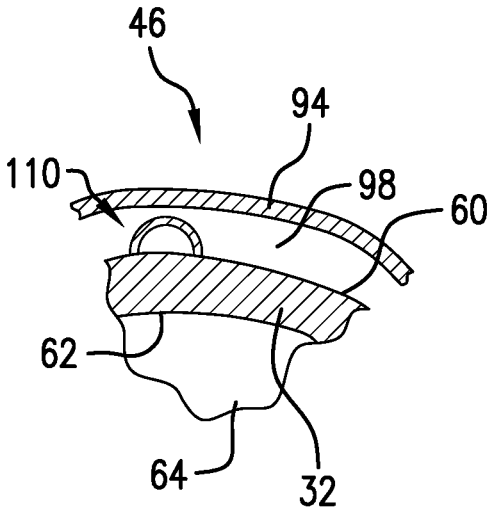
FIG. 4 depicts an axial cross-sectional view of the recirculating gravel pack system of FIG. 2 taken along the line 4-4, in accordance with an exemplary aspect.

In accordance with an exemplary aspect, a return tube 110 extends along outer surface 60 at sand screen system 46. Return tube 110 includes a first end arranged in screen passage 98 and a second end 114 that terminates uphole relative to first support member 90 and downhole relative to frac port 72. Return tube 110 may be supported by first support member 90. Referring to FIG. 3 and with continued reference to FIG. 2, first support member 90 includes an inner annular surface 128, an outer annular surface 130, an outer annular edge 132, and an inner edge 134 that may be scalloped. That is, inner edge 134 may include a plurality of semi-circular notches that accommodate a non-circular cross-section of each return tube 110 as shown in FIG. 4.

In operation, a gravel pack operation is initiated from surface system 16. A fluid containing an entrained slurry is introduced into tubular string 30 and flowed downhole. With valve member 79 being closed and frac port 72 being open, the fluid and slurry enter the annulus between outer surface 60 and inner annular wall 38. The slurry begins to build up forming a gravel pack over screen element 94. As shown in FIG. 2, a portion of the fluid flows through screen element 94 into screen passage 98 creating a filtered portion of the fluid. Remaining portions of the fluid leakoff or exit into formation 36.

In an embodiment, the fluid exiting frac port 72 creates a low pressure zone 144. That is, frac port 72 has a first area A1 and the annulus or area between screen element 94 and inner annular wall 28 has a second area A2 that is larger than A1. The fluid flowing from A1 toward A2 generates a venturi or coanda effect that forms low pressure zone 144. Low pressure zone 144 draws the filtered portion of fluid into inlet 116 of return tube 110. The filtered portion of the fluid passes from outlet 118 and mixes with the fluid flowing from frac port 72. In this manner, the gravel pack operation may continue without the need for additional tools and or systems for directing the fluid back uphole or storing/filtering the fluid at the surface.

Figure 5:
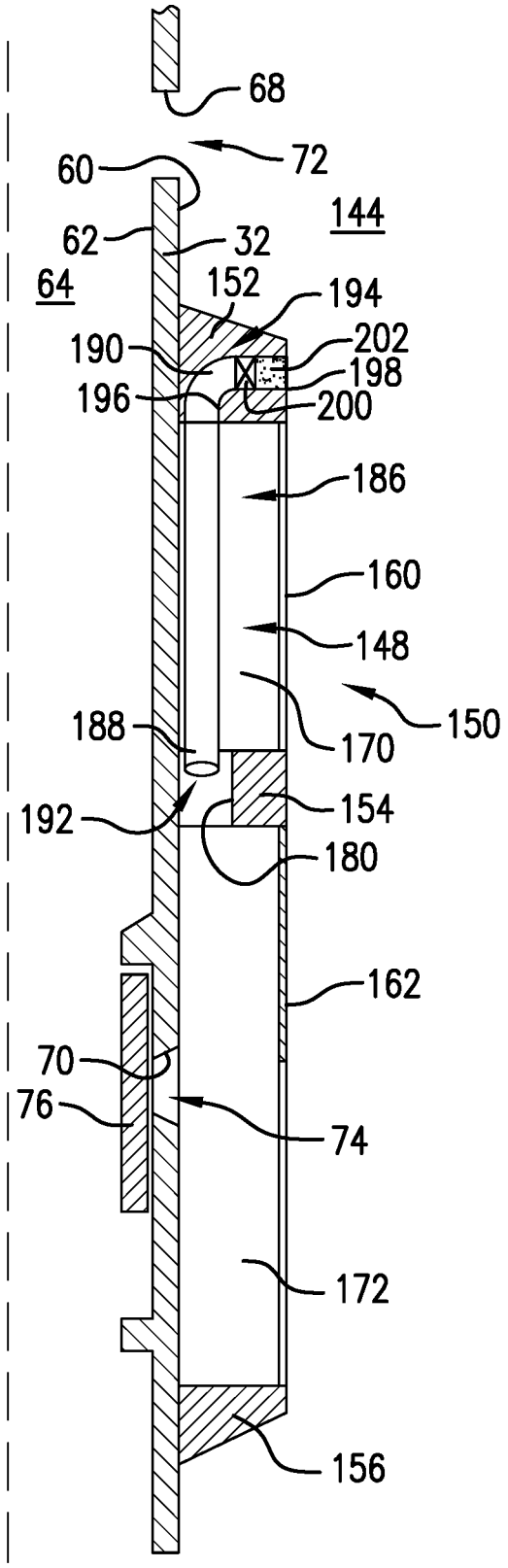
FIG. 5 depicts a partial cross-sectional view of a recirculating gravel pack system, in accordance with another aspect of an exemplary embodiment.

Reference will now follow to FIG. 5, wherein like reference numbers represent corresponding parts in the respective views, in describing a recirculating gravel pack system 148 associated with a sand screen system 150 in accordance with an exemplary embodiment. In an embodiment, sand screen system 150 includes a first support member 152, second support member 154 positioned downhole of first support member 152, and a third support member 156 positioned downhole of second support member 154. A screen element 160 is arranged between first support member 152 and second support member 154. Screen element 160 may include one or more layers of perforated materials that filter production fluids passing into flow path 64.

A shroud 162 extends between second support member 154 and third support member 156. A screen passage 170 is defined between outer surface 60 and an inner surface (not separately labeled) of screen element 160. A production chamber 172 is defined between outer surface 60 and an inner surface (also not separately labeled) of shroud 162. Production chamber 172 is fluidically connected with screen passage 170 via a production passage 180 formed in second support member 154.

In an embodiment, a return tube 186 is disposed on outer surface 60. Return tube 186 includes a first end 188 that may reside in production passage 180 and a second end 190 that may reside in first support member 152. First end 188 defines an inlet 192 and second end 190 defines an outlet 194. Second end 190 extends into a channel 196 formed in first support member 152. Channel 196 includes an outlet portion 198 that is exposed to low pressure zone 144.

In a manner similar to that described herein, low pressure zone 144 draws the filtered portion of fluid into inlet 192 of return tube 186. The filtered portion of the fluid passes from outlet 194 and through outlet portion 198 of channel 196 and mixes with the fluid flowing from frac port 72. In this manner, the gravel pack operation may continue without the need for additional tools and or systems for directing the fluid back uphole or storing/filtering the fluid at the surface.

In an embodiment, outlet portion 198 may include a check valve 200 that prevents a reverse flow through return tube 186. That is, check valve 200 permits fluid flow from inlet to outlet portion 198 while, at the same time, preventing fluid from entering outlet portion 198 and flowing toward inlet 192. In another embodiment, a filter 202 may be disposed in outlet portion 198. Filter 202 further filters the filtered portion of fluid passing through return tube 186. It should be understood that recirculating gravel pack system 148 may include check valve 200 and/or filter 202 or may be provided without either. Regardless of which is or is not provided, recirculating gravel pack system 148 achieves a desired gravel pack operation without the need for additional tools and or systems for directing the fluid back uphole or storing/filtering the fluid at the surface. In this manner, a smaller wellbore may be drilled and fewer components may be needed thereby saving time and costs associated with formation fluid removal.

Set forth below are some embodiments of the foregoing disclosure:

Embodiment 1

A recirculating gravel pack system comprising: a tubular member having an outer surface, an inner surface defining a flow path, a first opening extending from the inner surface through the outer surface and a second opening, spaced from the first opening extending from the inner surface through the outer surface; a screen positioned about the tubular member spaced from the outer surface defining a passage that is selectively fluidically connected to the second opening; and a return tube extending between the screen and the outer surface running axially along the tubular member, the return tube including a first end defining an inlet arranged in the passage and a second end defining an outlet positioned in a low-pressure zone outside the passage downhole from the first opening.

Embodiment 2

The recirculating gravel pack system according to any prior embodiment, further comprising: a support ring arranged between the outer surface and the screen, the support ring maintaining the passage between the tubular member and the screen.

Embodiment 3

The recirculating gravel pack system according to any prior embodiment, wherein the return tube extends through the support ring, the second end being axially spaced from the support ring.

Embodiment 4

The recirculating gravel pack system according to any prior embodiment, wherein the return tube terminates in the support ring.

Embodiment 5

The recirculating gravel pack system according to any prior embodiment, wherein the support ring includes an inner annular surface, an outer annular surface, and an annular edge extending radially outwardly of the tubular member, a channel extends from the passage into the inner annular surface, the channel includes an outlet portion.

Embodiment 6

The recirculating gravel pack system according to any prior embodiment, wherein the outlet is positioned in the annular edge.

Embodiment 7

The recirculating gravel pack system according to any prior embodiment, further comprising: one of a check valve and a filter in the channel.

Embodiment 8

A resource exploration and recovery system comprising: a surface system; and a subsurface system including a recirculating gravel pack system comprising: a tubular member having an outer surface, an inner surface defining a flow path, a first opening extending from the inner surface through the outer surface and a second opening, spaced from the first opening extending from the inner surface through the outer surface; a screen positioned about the tubular member spaced from the outer surface defining a passage that is selectively fluidically connected to the second opening; and a return tube extending between the screen and the outer surface running axially along the tubular member, the return tube including a first end defining an inlet arranged in the passage and a second end defining an outlet positioned in a low-pressure zone outside the passage downhole from the first opening.

Embodiment 9

The resource exploration and recovery system according to any prior embodiment, further comprising: a support ring arranged between the outer surface and the screen, the support ring maintaining the passage between the tubular member and the screen.

Embodiment 10

The resource exploration and recovery system according to any prior embodiment, wherein the return tube extends through the support ring, the second end being axially spaced from the support ring.

Embodiment 11

The resource exploration and recovery system according to any prior embodiment, wherein the return tube terminates in the support ring.

Embodiment 12

The resource exploration and recovery system according to any prior embodiment, wherein the support ring includes an inner annular surface, an outer annular surface, and an annular edge extending radially outwardly of the tubular member, a channel extends from the passage into the inner annular surface, the channel includes an outlet portion.

Embodiment 13

The resource exploration and recovery system according to any prior embodiment, wherein the outlet is positioned in the annular edge.

Embodiment 14

The resource exploration and recovery system according to any prior embodiment, further comprising: one of a check valve and a filter in the channel.

Embodiment 15

A method of gravel packing comprising: directing a flow of fluid including a slurry into a tubular member; passing the flow of fluid from the tubular member into a wellbore; accumulating slurry at a sand screen supported by the tubular member; passing a filtered portion of the flow of fluid into a passage arranged radially inwardly of the sand screen; drawing the filtered portion of the flow of fluid into a return tube having an outlet; and discharging the filtered portion of the flow of fluid from the outlet into the flow of fluid passing from the tubular member.

Embodiment 16

The method according to any prior embodiment, wherein drawing the filtered portion of the flow of fluid into the return tube includes creating a low pressure zone at the outlet.

Embodiment 17

The method according to any prior embodiment, further comprising: preventing fluid flow into the outlet of the return tube with a check valve.

Embodiment 18

The method according to any prior embodiment, further comprising: further filtering the filtered portion of the flow of fluid passing through the return tube.

Embodiment 19

The method according to any prior embodiment, wherein passing the flow of fluid from the tubular member includes discharging the flow of fluid through a selectively openable frac port.

Embodiment 20

The method according to any prior embodiment, wherein discharging the filtered portion of the flow of fluid passing from the tubular member includes discharging the filtered portion of the flow of fluid downhole of the selectively openable frac port.

Embodiment 21

The method according to any prior embodiment, further comprising: directing a portion of the flow of fluid into the formation radially outwardly of the sand screen.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A recirculating gravel pack system comprising:

a tubular member having an outer surface, an inner surface defining a flow path, a first opening extending from the inner surface through the outer surface and a second opening, spaced from the first opening extending from the inner surface through the outer surface;

a screen positioned about the tubular member spaced from the outer surface defining a passage that is selectively fluidically connected to the second opening; and a return tube extending between the screen and the outer surface running axially along the tubular member, the return tube including a first end defining an inlet positioned longitudinally inside the screen and arranged in the passage and a second end defining an outlet positioned longitudinally outside of the screen in a low-pressure zone outside the passage downhole from the first opening.

2. The recirculating gravel pack system according to claim 1, further comprising: a support ring arranged between the outer surface and the screen, the support ring maintaining the passage between the tubular member and the screen.

3. The recirculating gravel pack system according to claim 2, wherein the return tube extends through the support ring, the second end being axially spaced from the support ring.

4. The recirculating gravel pack system according to claim 2, wherein the return tube terminates in the support ring.

5. The recirculating gravel pack system according to claim 2, wherein the support ring includes an inner annular surface, an outer annular surface, and an annular edge extending radially outwardly of the tubular member, a channel extends from the passage into the inner annular surface, the channel includes an outlet portion.

6. The recirculating gravel pack system according to claim 5, wherein the outlet is positioned in the annular edge.

7. The recirculating gravel pack system according to claim 5, further comprising: one of a check valve and a filter in the channel.

8. A resource exploration and recovery system comprising:

a surface system; and a subsurface system including a recirculating gravel pack system comprising:

a tubular member having an outer surface, an inner surface defining a flow path, a first opening extending from the inner surface through the outer surface and a second opening, spaced from the first opening extending from the inner surface through the outer surface;

a screen positioned about the tubular member spaced from the outer surface defining a passage that is selectively fluidically connected to the second opening; and a return tube extending between the screen and the outer surface running axially along the tubular member, the return tube including a first end defining an inlet positioned longitudinally inside the screen and arranged in the passage and a second end defining an outlet positioned longitudinally outside of the screen in a low-pressure zone outside the passage downhole from the first opening.

9. The resource exploration and recovery system according to claim 8, further comprising: a support ring arranged between the outer surface and the screen, the support ring maintaining the passage between the tubular member and the screen.

10. The resource exploration and recovery system according to claim 9, wherein the return tube extends through the support ring, the second end being axially spaced from the support ring.

11. The resource exploration and recovery system according to claim 9, wherein the return tube terminates in the support ring.

12. The resource exploration and recovery system according to claim 9, wherein the support ring includes an inner annular surface, an outer annular surface, and an annular edge extending radially outwardly of the tubular member, a channel extends from the passage into the inner annular surface, the channel includes an outlet portion.

13. The resource exploration and recovery system according to claim 12, wherein the outlet is positioned in the annular edge.

14. The resource exploration and recovery system according to claim 12, further comprising: one of a check valve and a filter in the channel.

15. A method of gravel packing comprising:

directing a flow of fluid including a slurry into a tubular member;

passing the flow of fluid from the tubular member into a wellbore;

accumulating slurry at a sand screen supported by the tubular member;

passing a filtered portion of the flow of fluid into a passage arranged radially inwardly of the sand screen;

drawing the filtered portion of the flow of fluid into a return tube extending between the sand screen and an outer surface of the tubular member running axially along the tubular member, the return tube having an inlet positioned longitudinally inside of the sand screen and an outlet positioned longitudinally outside of the sand screen; and discharging the filtered portion of the flow of fluid from the outlet into the flow of fluid passing from the tubular member.

16. The method of claim 15, wherein drawing the filtered portion of the flow of fluid into the return tube includes creating a low pressure zone at the outlet.

17. The method of claim 15, further comprising: preventing fluid flow into the outlet of the return tube with a check valve.

18. The method of claim 15, further comprising: further filtering the filtered portion of the flow of fluid passing through the return tube.

19. The method of claim 15, wherein passing the flow of fluid from the tubular member includes discharging the flow of fluid through a selectively openable frac port.

20. The method of claim 19, wherein discharging the filtered portion of the flow of fluid passing from the tubular member includes discharging the filtered portion of the flow of fluid downhole of the selectively openable frac port.

21. The method of claim 15, further comprising: directing a portion of the flow of fluid into the formation radially outwardly of the sand screen.

* * * * *